United States Patent [19]

Gabriel

[11] Patent Number: 4,717,189

[45] Date of Patent: Jan. 5, 1988

[54] TONG-LIKE, CABLE-SCOOPING, HOIST-CABLE COUPLING DEVICE FOR SUSPENDED LOADS

[76] Inventor: Edwin Z. Gabriel, 91 Mt. Tabor Way, Ocean Grove, N.J. 07756

[21] Appl. No.: 846,228

[22] Filed: Mar. 31, 1986

[51] Int. Cl.[4] ..... B66C 1/38

[52] U.S. Cl. ..... 294/82.32; 294/82.3

[58] Field of Search ..... 294/82.18, 82.24–82.27, 294/82.3–82.34, 75, 88, 110.1, 118; 24/232 R, 232 G, 241 P, 241 PP, 241 PS, 241 SB, 242

[56] References Cited

U.S. PATENT DOCUMENTS

| | | | |
|---|---|---|---|
| 67,989 | 8/1867 | Kempton | 294/82.27 |
| 373,325 | 11/1887 | Willing | 294/82.27 |
| 1,346,160 | 7/1920 | Barlow | 294/88 |
| 1,507,706 | 9/1924 | Miller et al. | 294/82.32 |
| 1,808,689 | 6/1931 | Stenhouse et al. | 294/118 X |
| 2,213,014 | 8/1940 | Owen | 294/88 |
| 3,164,406 | 1/1965 | Barry | 294/110.1 X |
| 3,655,233 | 4/1972 | Twist | 294/118 |
| 4,452,481 | 6/1984 | Williams | 294/118 |

*Primary Examiner*—Johnny D. Cherry

[57] ABSTRACT

The hoist-cable coupling device is tong-like in appearance, pivoted near its center and weighted on top to force its lower portions to automatically separate when lowered onto a platform to discharge its load cable. When lifted, its lower ends are designed to scoop up the load cable. Its lower mating ends are protected from high compressive stresses caused by heavy loads by inwardly protruding extensions with hammerheads, located either above or below the pivoted point. In one version a solenoid with shaft extension and hook to engage an opposing hook is included, for positive load retention. In another version an electromagnet is incorporated into the above hammerheads for accomplishing the positive load retention. Unless voltage is applied to either the solenoid or the electromagnet, its lower mating portions will under no circumstances separate and discharge the load cable suspending a load.

11 Claims, 33 Drawing Figures

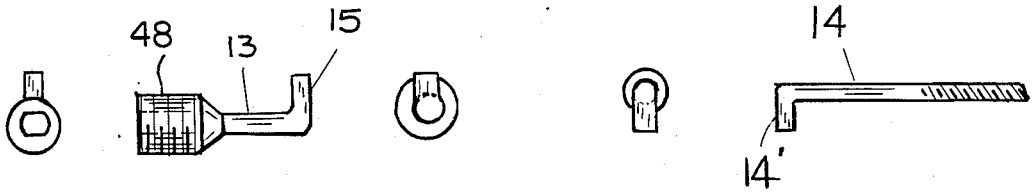
Fig. 13 Fig. 12 Fig. 14 Fig. 11 Fig. 10
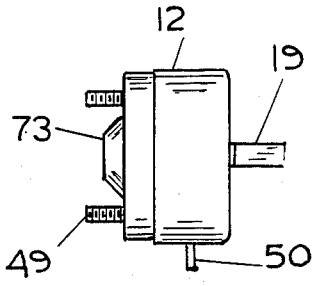
Fig. 15
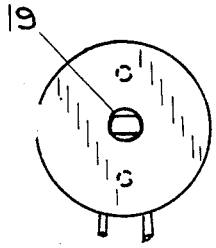
Fig. 16
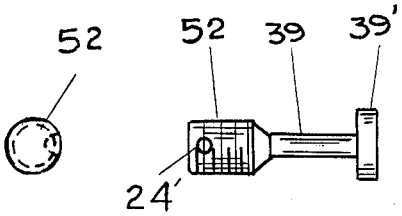
Fig. 18 Fig. 17
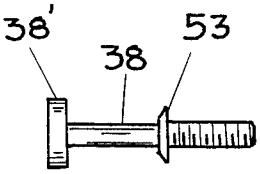
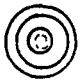
Fig. 19 Fig. 20
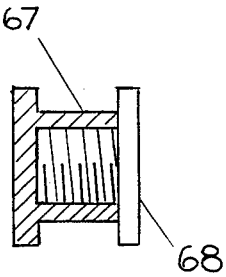
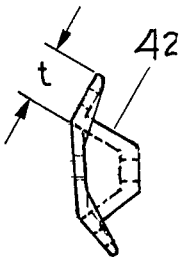
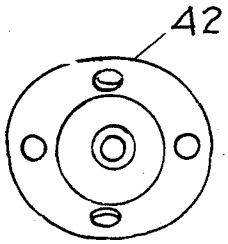
Fig. 23 Fig. 21 Fig. 22

TONG-LIKE, CABLE-SCOOPING, HOIST-CABLE COUPLING DEVICE FOR SUSPENDED LOADS

BACKGROUND OF THE INVENTION

In the past the operations of loading and unloading of cargo have been performed manually, although the unloading of cargo has been performed by remote control signals for externally slung helicopter loads. Ground personnel have had to manually place the cable over the cargo hook, to enable cargo to be lifted by a hoist cable. In addition, in no known publicized instance has cargo been automatically unloaded without the application of an electrical or hydraulic signal. Signal control systems can be damaged, making necessary for the unloading operation to be manually performed. There may be hazardous environmental conditions in which both the loading and unloading operations should be performed without the presence of ground personnel at the loading platform. This may be particularly true at toxic waste sites and under other hazardous environmental situations. In both military and nonmilitary operations, helicopters need to pick up cargo from a hilly or wooded area and transport such cargo to another site. Many times the loading and unloading operations are hazardous because of the air currents from the rotor and wind gusts, for the tasks to be done entirely manually. In some operations, ammunition, weapons, toxic chemicals in containers need to be moved and transported from one site to another. It would be safer and quicker not to have ground personnel loading and unloading such load items manually. Presently, containerized toxic materials are loaded manually by ground personnel so they can be moved to a safe dumping area. It would be safer and less hazardous to human life if such cargo could be loaded and unloaded automatically without the aid of ground personnel.

Presently, Breeze-Eastern, Union, N.J., supplies the military with complex cargo hooks, capable of unloading the cargo load cable automatically with the application of a signal to a solenoid, within the cargo hook. A separate insulated, shielded wire is used to transmit the signal from a remote switch. The Breeze cargo hook is incapable of automatically loading the load cable. A typical 6000 Lb. capacity Breeze cargo hook requires, for release at dropping capacity, 22–28 VDC at 12 to 15 amperes, and a minimum release load of 7 Lbs. for 1⅜" travel of the rotatable hook portion.

Cargo hooks made by Columbus McKinnon Corp., Amherst, N.Y. and by B. E. Wallace Products Corp., Exton, Pa., are strictly mechanical hooks with no automatic loading or unloading features.

In this invention, with or without a solenoid, the coupling device is capable of both loading and unloading a load cable automatically. Without a solenoid, the device is capable of performing both operations without the requirement of an electrical signal and still capable of safely transporting cargo.

SUMMARY OF THE INVENTION

The present invention describes a novel, tong-like load cable-scooping coupling device, for suspending and transporting cargo. The device has automatic cargo loading and unloading capabilities. Two versions are provided,—with and without a rotary solenoid. The solenoid version provides positive retension of the load under all environmental conditions. The load cable cannot be removed from the device without a signal being applied to the solenoid. In mid-air, even a signal accidentally applied to the solenoid cannot disengage the load cable from the device. Only when the cable is cut, as with a cable cutter at the winch location, can the load be freed of the device, rather freed of the hoist cable. The hoist-cable-cutting would be performed under load-suspended emergency conditions.

The same basic structure is used for both versions of the device, so that when the solenoid's presence seems unnecessary, it can be removed, and the device is then used without a solenoid.

The device comprises two relatively flat elongated members, pivoted near their mid-section with a pivot pin. The device is capable of scooping up a cable, when lifted, by virtue of the sharpened ends of its lower portions and its weight distribution.

Both versions, with and without a solenoid, are furnished with rods having hammer heads at their butting ends. One elongated rod is mounted on each upper or lower portion of the device and each rod extends approximately half way across, when the device's lower ends are engaged and make contact. The butted hammerhead ends help share the stress produced at the lower dovetailed ends when the device suspends a heavy load.

Voltage to the solenoid version is from a power supply located at the winch location. A separate cable line heading from the winch to the solenoid would be provided, via switches, not shown in the mechanical drawings, but shown in the electrical schematic.

In the version without a solenoid, unloading of suspended cargo is virtually impossible unless or until tension in the hoist cables is reduced significantly, by the load coming to rest on a stationary object, such as a rigid surface. When the suspended load does come to rest on a surface, causing the cables to slacken, the device's lower portions will automatically separate, by reason of the resultant torques of the upper portions being greater than those of the lower portions. After unloading the load cable, due to gravity, the device is again lifted, restoring some tension in the hoist cable due to the weight of the device itself, causing the device's lower curved portions to come together. Now the device is free to be reused for loading additional cargo. Exposed threadportions or areas of the device are either capped or shrouded with an enclosure for protection from dirt.

BRIEF DESCRIPTION OF DRAWINGS

For the purpose of illustrating the invention, the following drawings show forms which are presently preferred. It is to be understood, however, that this invention is not necessarily limited to the precise arrangement, instrumentalities and field of utility as therein demonstrated.

FIG. 10 is a side view of a rod with threads at one end and a bent opposite end.

FIG. 11 is an end view thereof.

FIG. 12 is a side view of the solenoid shaft extension with a hole inside of one end and with a right angle bend on its other end.

FIG. 13 is an end view thereof.

FIG. 14 an end view thereof looking from its opposite end.

FIG. 15 is a side view of the rotary solenoid manufactured by LEDEX Inc., having a shaft with flattened sides.

FIG. 16 is a front view thereof.

FIG. 17 is a rod with a threaded end at one end and a hammer head at its opposite end.

FIG. 18 is an end view thereof.

FIG. 19 is a rod with a threaded portion at one end and a hammer head at its opposite end, this hammer head to butt against the hammer head of FIG. 17.

FIG. 20 is an end view thereof.

FIG. 21 is a side view of a solenoid shaft extension bracket.

FIG. 22 is a front view thereof.

FIG. 23 is a sectional view of the device's pivot pin along line 23—23, FIG. 1.

DESCRIPTION OF THE PREFERRED EMBODIMENT

Coupling device 100 is a cable-scooping, hoist cable coupling device capable of loading and unloading cargo automatically, with minimum aid of ground personnel.

Figure 2:
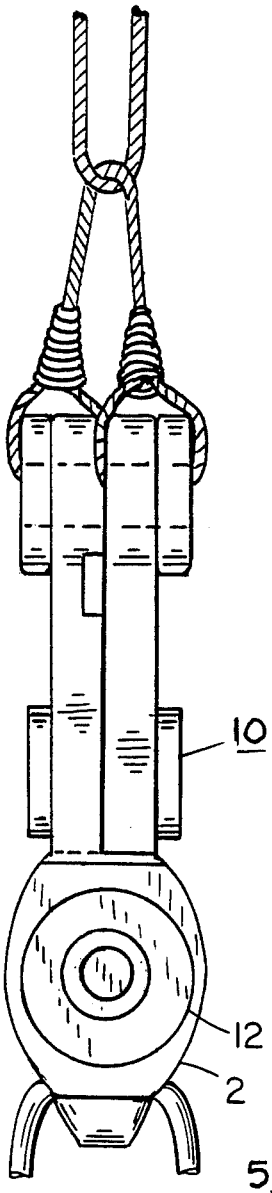
FIG. 2 is a side view thereof.
Figure 1:
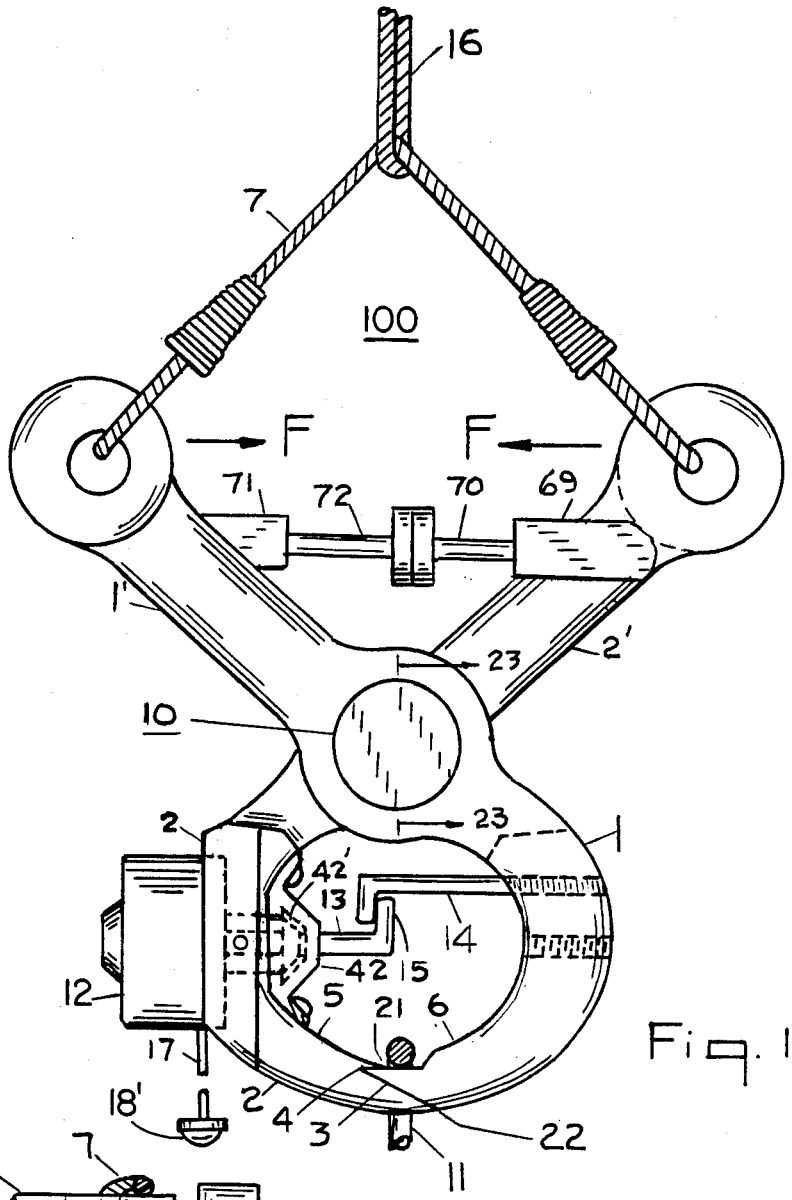
FIG. 1 is a front assembly view of a hoist cable coupling device with positive retention capability of the load cable. It is tonglike in appearance with the ends of its lower portions overlapping when coupled. A rotary solenoid is supported on its lower side with an elongated hook-like attachment to provide the desired positive retention under all environmental conditions.
Figure 3:
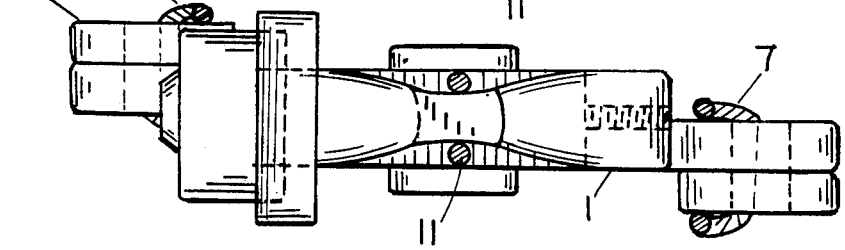
FIG. 3 is a bottom view thereof, showing another view of the device and the curved line of contact between the two sharply-curved lower portions.

FIGS. 1 to 3 show a version of device 100 with rotary solenoid 12 mounted on its left lower side 2, for remote signal operation. In FIG. 1, under suspended load conditions device 100 is held in closed coupling engagement because of the horizontal components of force F of cable 7 and the vertical forces on overlapping surfaces 3. In addition it is held closed because of solenoid 12 with its attached elongated arm 13. Here solenoid 12 is fastened to the side of lower portion 2. Portion 2 has a shallow cylindrical cavity to help keep the solenoid precisely in position. Elongated arm 13 with a right angle hook 15 on its end, and rigidly attached to solenoid shaft 19, is shown engaged with another rod 14 having a similar right angle hook. The solenoid could be a LEDEX part No. 1142–033 with a 90° stroke and spring return. For mounting, it has two 3-48NC-2A threaded screws extending outward. For a duty cycle f=On-time/(ON+OFF-time) of 1/10th second, where the longest single impulse is 7 seconds, its starting torque is 0.080 pound-inch. The next size LEDEX solenoid 2E with an outside diameter of 1 5/32 inches, would exert a torque of 1.40 pound-inches. Normally with solenoid 12 de-energized, hook 15, FIG. 1, engages rod 14, as shown, to assure that device 100 is coupled under all environmental conditions. When energized, solenoid's shaft 19 rotates sufficiently to be free of rod 14's hook. This allows portions 1 and 2 to separate under no load conditions, in particular when the suspended load has made contact with a rigid surface below. Recess surface 21, supporting cable 11, assumes an angle of approximately 45° from the horizontal, when coupling device is opened as in FIG. 4, and cable 11 is urged to detach itself from device 100, due to gravity. The procedure is described below, with rods 13 and 14 disengaged.

Figure 4:
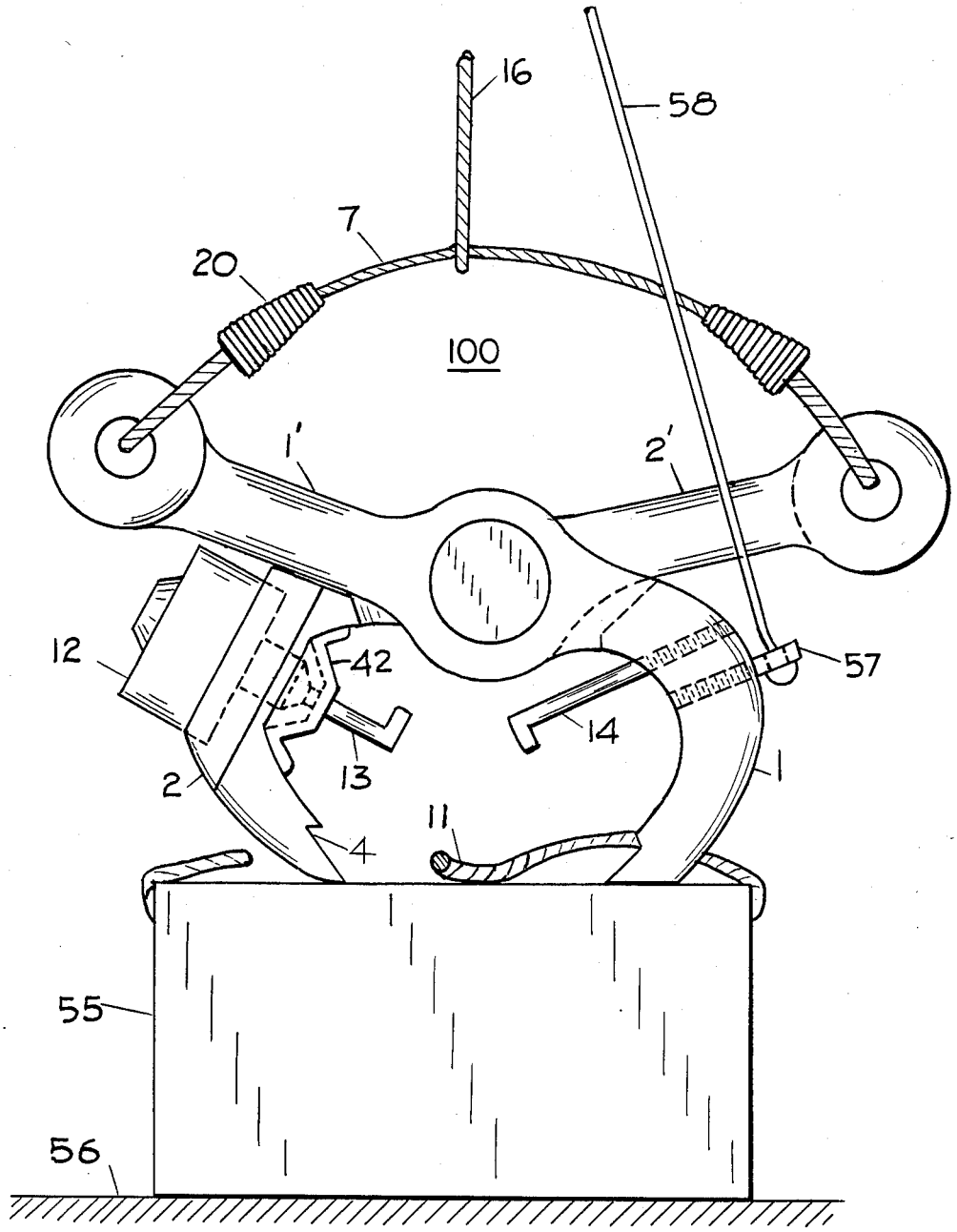
FIG. 4 is a front view of the cable-scooping device with its lower portions separated for discharging the load cable.
Figure 6:
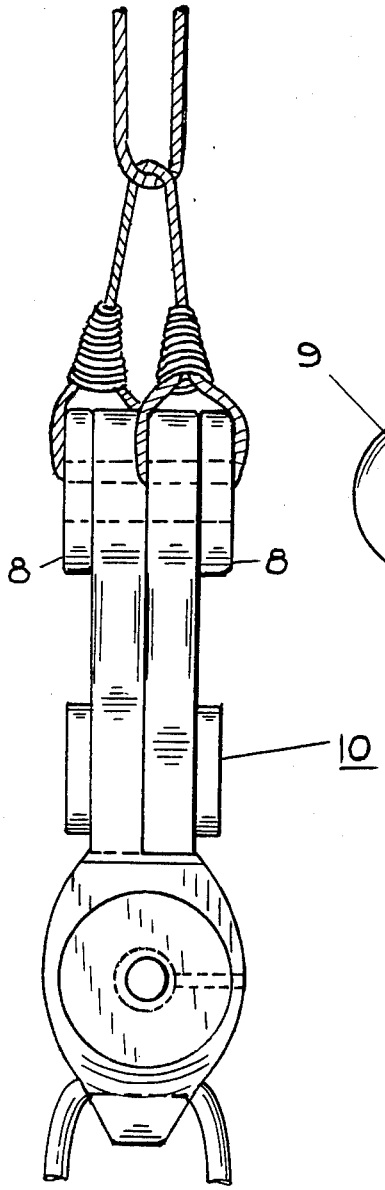
FIG. 6 is a side view thereof.

In FIG. 4, when load 55 makes contact with platform surface 56, cable 11 slackens. Without significant forces acting on contact surfaces 3, and with substantially less tension on hoist cables 7 and 16, lower portions 1 and 2 are forced to move apart by the force of gravity. To explain, when cable 11 becomes slack, the tensile stresses on hoist cable 7 diminish, too. If upper portions 1' and 2' have larger resultant torques than lower portions 1 and 2, due to weights 8, then elongated portions 1' and 2' will be forced to move outward due to gravity, causing lower portions 1 and to separate, too. This effect would cause cable 11 to free itself of device 100, again due to gravity, as shown in FIG. 4.

Figure 8:
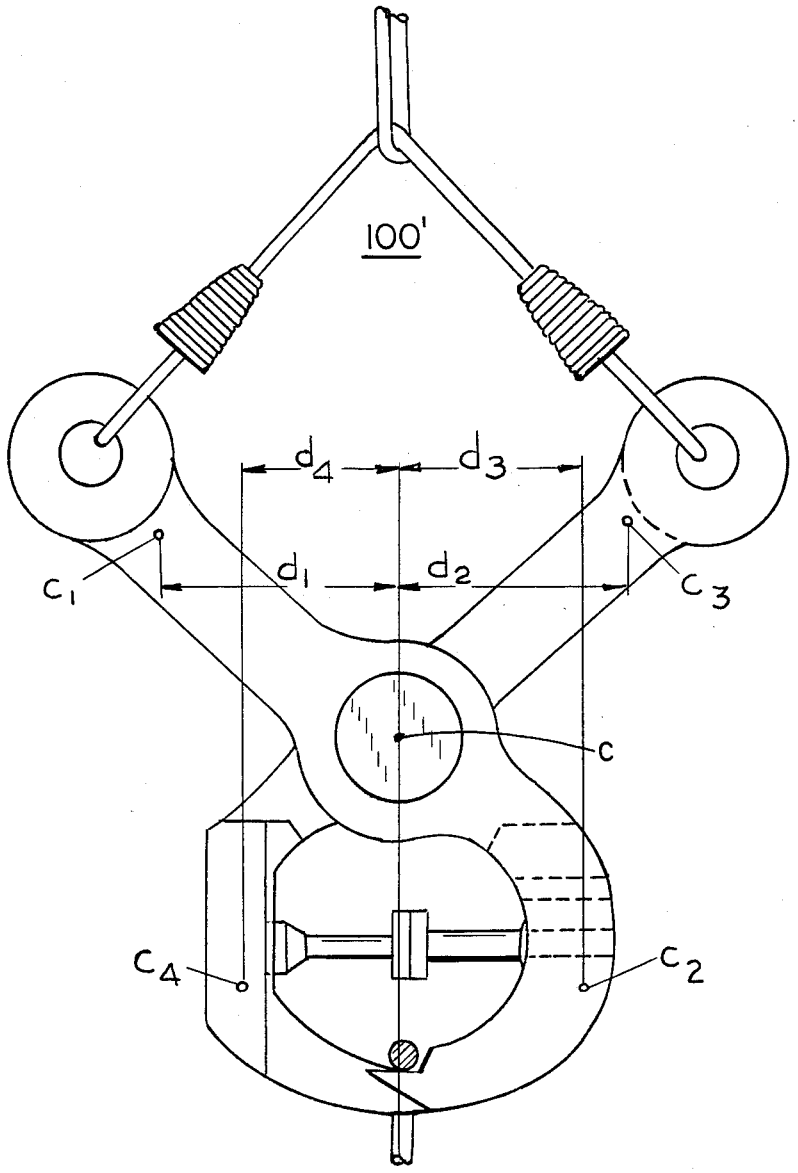
FIG. 8 provides a model showing torque mathematical relationships between upper and lower portions of the hoist cable coupling device, a relationship for both versions of the device described.

Sloping surfaces 3 are polished to aid in cable 11 sliding off surface 3 when ends of portions 5 and 6 separate from one another. Mathematically, see (FIG. 8), for the separation of lower portions to occur, the following relationships should exist: a. $c_1d_1 > c_2d_3$; b. $c_3d_2 > c_4d_4$, where the c's are the centroids or the centers of mass, and the d's represent their perpendicular distances to center of pivot pin 10, $C_p$. For the above mathematical relationship to be assured, additional mass may be added to upper portions 1' and 2'. When the coupling device is free of the load cable, it is then ready to be used elsewhere. FIGS. 2 and 3 are the side and bottom views of device 100, respectively, showing the thicknesses of its various portions. FIGS. 10 and 11 show two views of rod 14, while FIGS. 12, 13 and 14 show three views of shaft extension 13. Solenoid 12 is an off-the-shelf item and its dimensions can be found in the LEDEX Inc catalog, Dayton, Ohio 45402. Device 100 may be used without solenoid 12 when extreme safety precautions are not warranted.

It should be mentioned that set screw 41', FIG. 1, holds shaft extension 13 onto shaft 19 of solenoid 12. Shaft 19 may be externally fluted and the shaft-end hole of extension 13 may be internally fluted. To summarize the construction and performance of coupling device 100 the device is designed to quickly release cargo remotely and automatically, by virtue of its forceps-like construction and weight distribution, having upper and lower portions pivoted near their midsection by a pivot pin. Ends of lower portions 5 and 6 are forced into contact with each other because of the horizontal components of tension in cable 7, when device 100 is supporting a load. Ends of 5 and 6 have complementary surfaces which overlap with each other, when a load is being suspended from cable 11. While cable 11 is being directly supported by portion 6, it should be observed that portion 5 also helps support cable 11, by virtue of the overlapping ends. Lower sharply-curved portions 1 and 2 will separate only when both the tension in hoist cable 7 is significantly reduced and sufficiently slack is developed in load cable 11, to allow cable 11 to disengage itself from device 100. Ends of portions 5 and 6 will make overlapping contact with each other again as soon as tension is restored in hoist cable 7.

Figure 9:
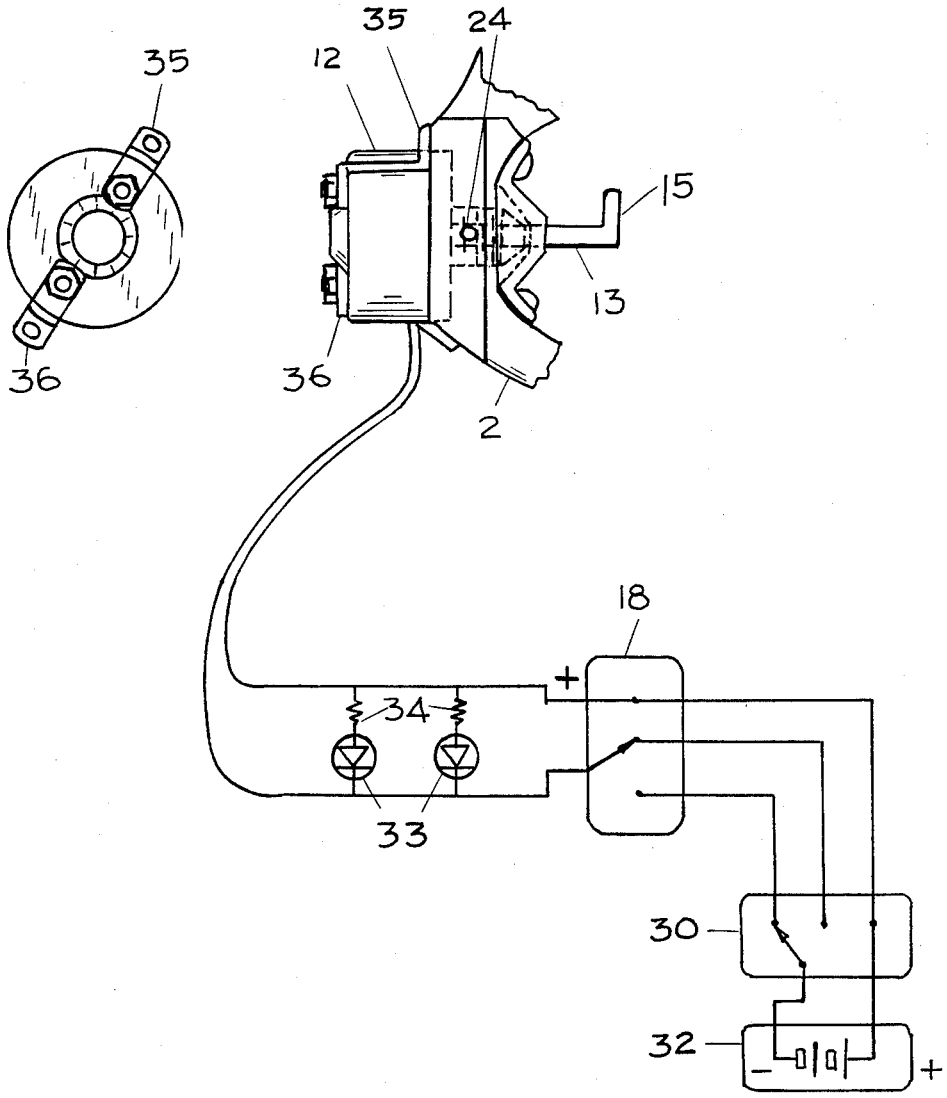
FIG. 9 shows the circuit diagram for operation of the device's solenoid, including switches, power supply and LEDs.

To activate solenoid 12, FIG. 1, switch 18 is depressed by an operator. Switch 18 is one of two SPDT switches shown in FIG. 9. FIG. 9 shows the solenoid fixed to the side of device 100 and its circuitry, including two momentary-ON SPDT switches 18 and 30, each capable of activating the solenoid, a power supply 32 and two LEDs 33 which illuminate when solenoid 12 is energized. The LEDs are located in front and rear of device 1, FIG. 1, to alert personnel that solenoid 12 is activated. Switches 18 and 30 are placed at locations remote from device 100 and convenient for personnel to operate. Power supply 32 may be located in the hoist cable operator's cabin. The electrical conductor from the solenoid to the power supply may run either inside of the hoist cables or outside of them in its own protective covering. Resistors 34, FIG. 9, are wired in series with the LEDs, as shown. Brackets 35 and 36 and a third behind solenoid 12, not shown, may be added to support and keep solenoid 12 firmly in place.

Device 100 in FIG. 1, which includes solenoid 12, has been designed to function without the solenoid in place, when a solenoid is not seen as an absolute requirement for positive retention of the suspended load.

Figure 5:
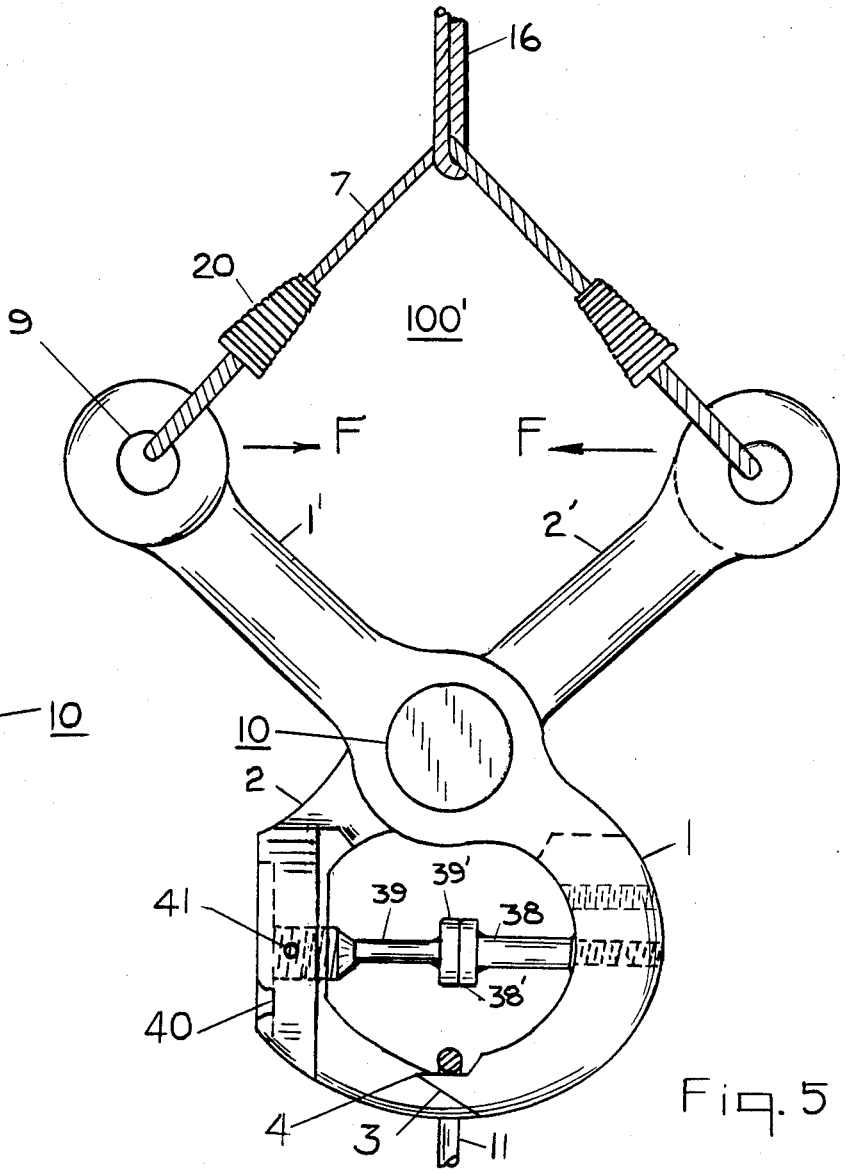
FIG. 5 shows a front assembly view of the device of FIG. 1 without the solenoid and with substitutions for the shaft extension and the rod to indicate that the same device may be used without a solenoid, if desired.
Figure 7:
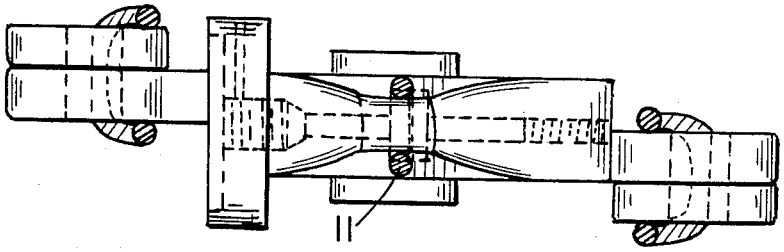
FIG. 7 is a bottom view thereof.

FIG. 5 is a front view of the cable-loading device without a solenoid. The solenoid has been removed and the shaft extension 13 replaced by member 39 with one end threaded and the other end with hammer head 39'. Portion 39' is shown abutted against cylindrical portion 38', another hammer head, of rod 38 with a threaded portion at its other end, screwed into lower portion 1 of device 100. The purpose of having the two enlarged portions 38' and 39' butting against each other is for them to help share the horizontal forces occurring at the overlapping area 3, when a heavy load is suspended. For very heavy loads, the horizontal forces at 3 would be very large and could cause bending to occur at the overlapping region. Horizontal structural members 38 and 39 would relieve some of the horizontal stress at overlapping area 3, FIG. 5. Both members 38 and 39 may be removed by unscrewing and then replaced by other members 13 and 14 when solenoid 12, FIG. 1, is added.

It should be mentioned that solenoid 12 with its shaft extension in place, could be screwed into the same threaded area of lower portion 2. After shaft extension 13 is fully inserted by screwing, bracket 42 with a proper size hole at its center would be inserted over bent end 15 of extension 13; then bracket 42 would be held in place with machine screws, as shown in FIG. 1. With bracket 42 firmly in place, member 13 cannot unscrew. Set screw 41', FIG. 5, for engaging flat portion of shaft 19, would be unnecessary as shaft extension 13 cannot rotate about solenoid shaft 19. Extension 13 would rotate or turn only when solenoid is energized. End 15 of shaft extension on 13 moves forward as it rotates 90°, disengaging rod 14, and allowing lower portions 1 and 2 to separate from each other. To further explain, when shaft 19 rotates, shaft extension 13 rotates, too, and moves forward slightly because of its threaded exterior. Thus, space 42' FIG. 1 is provided to allow for this forward motion.

Details of shaft extension 13 and rod 14 are shown in FIGS. 10 to 14. Rod 14 with its one end threaded and its other end 14' bent, is shown in FIG. 10, side view and in FIG. 11, end view. Shaft extension 13 with its enlarged end threaed and its other end bent 90°, is shown in FIG. 12, side view, and in FIG. 13, end view. Note that the hole in the end view has flat sides to accommodate and mesh with the flat sides of solenoid shaft 19, FIGS. 15 and 16. FIG. 14 shows extension 13's opposite end view. LEDEX rotary solenoid 12 is shown in FIG. 15, side view, and in FIG. 16, shaft-end view.

Details of rods 38 and 39, FIG. 5, are shown in FIGS. 17 to 20. Rod 39, with its one end threaded and its other end with a hammerhead 39', is shown in FIG. 17, side view, and in FIG. 18, end view. Rod 38, also with one end threaded and its other end with a similar hammerhead 38', is shown in FIG. 19, side view, and in FIG. 20, end view.

It should be mentioned that threaded holes for rods 14 and 38 are capped when either one is not in use to avoid their becoming clogged with dirt. Solenoid 12 has a moisture proof cap 73, FIG. 15.

Figure 24:
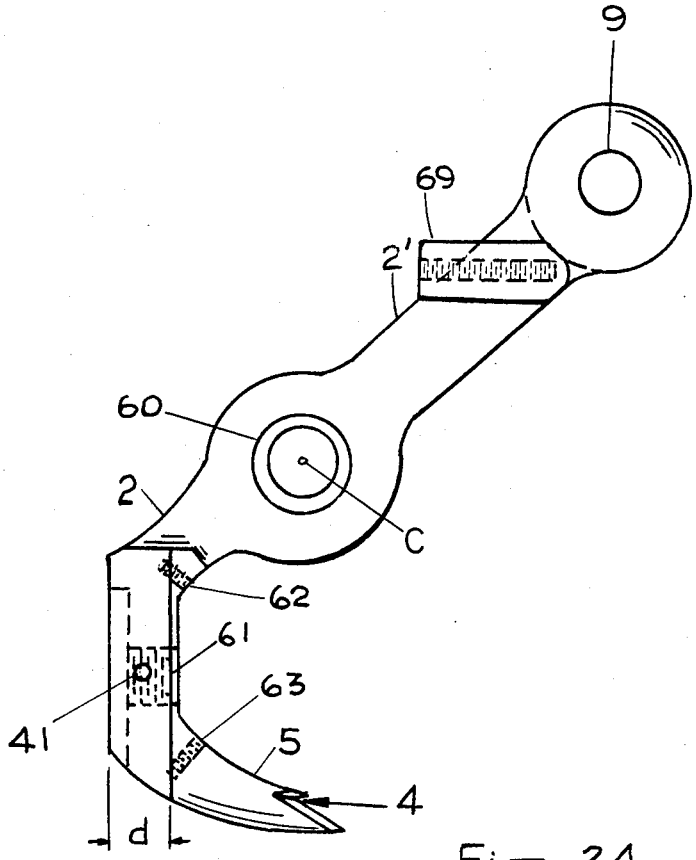
FIG. 24 is a front view of one-half of the coupling device of either FIG. 1 or FIG. 5 without the solenoid.

In FIGS. 24 and 5, indentation 4, for projection of the end of portion 6, assists in keeping overlapping lower ends in place under heavy suspended load conditions.

FIGS. 24 to 29 show details of the two halves comprising the device's structure.

Figure 26:
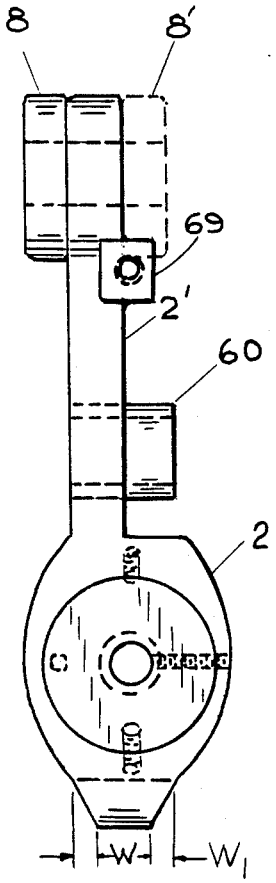
FIG. 26 is a side view thereof.
Figure 25:
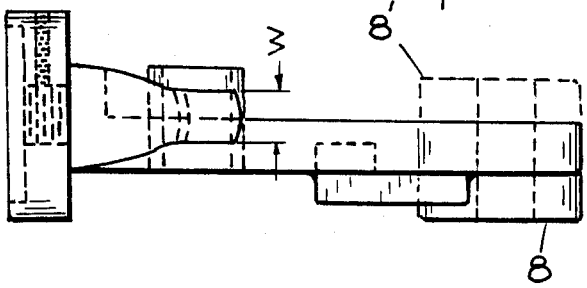
FIG. 25 is a bottom view thereof.
Figure 27:
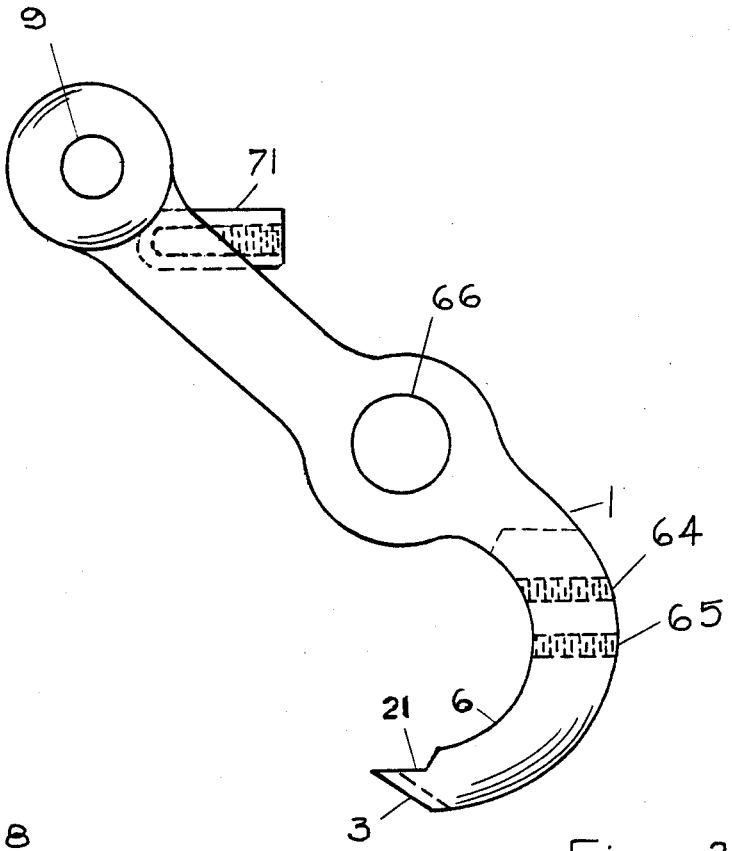
FIG. 27 is a front view of the other half of the coupling device shown in either FIG. 1 or FIG. 5, with the rods removed.
Figure 28:
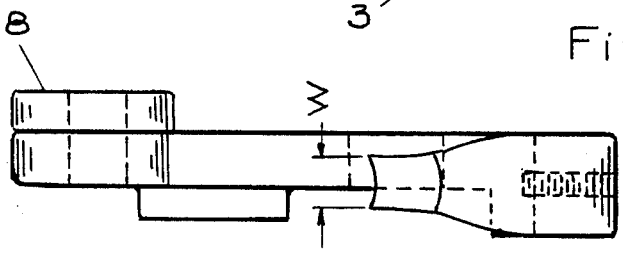
FIG. 28 is a bottom view thereof.

It should be noted that lower portion 2, FIG. 24, may be heavier than lower portion 1, FIG. 27, when solenoid 12 is mounted in place. To ensure that upper portion 2', FIG. 24, has a substantially higher torque about center C than lower portion 2 does, additional weight 8' is suggested, as shown in FIGS. 25 and 26.

Features of FIG. 24 that should be pointed out are threaded hole 41 for set screw 41', shown in FIG. 5. Screw 41' would not be required for shaft extension 13, FIG. 1. Then threaded holes 62 and 63 are for machine screws to hold bracket 42, FIG. 1, in place. In FIG. 24 depth d of portion 2 may be increased if it is desired to increase the depth of threaded hole 61, FIG. 24, for the device to suspend heavier loads. Width W, FIGS. 23 and 25, may be increased to width $W_1$, if it is desired for either device 100 or 100' to stand upright on a flat rigid surface. Hollow cylinder 60 may be a hard bronze bushing to enable pivot pin assembly 10 to rotate with less friction. A section of pin 10, FIG. 23, is along line 23–23, FIG. 5. FIG. 27 shows the front view of the other half of either device 100 or 100'. In this view, threaded holes 64 and 65 are shown. Hole 64 is for rod 14, FIG. 1, while hole 65 is for hammerhead rod 38, FIG. 5. When device 1 is used with solenoid 12, hole 65 is capped to keep out dirt. When device 100' is used without solenoid, then hole 64 is capped. Again, if it is desired for either device 100 or 100' to stand upright, width W may be increased to $W_1$, FIG. 26. Increasing W to width, FIG. 26 also would increase the strength of central lower portions at the recess area 21, FIGS. 1 and 5. Thus, either device would be capable of carrying heavier loads with the increased width $W_1$. A problem that may occur when unloading cargo onto a platform, such as 56, FIG. 4, is that the load cable 11 could be scooped up again when lifting or pulling up device 100, to be reused. To avoid this undesirable effect, a screw with eyelet 57 is applied and screwed into threaded hole 65, and cord 58 is attached to enable lower portion 1, FIG. 4, to remain separated from lower portion 2, until load cable 11 is completely free.

To help protect shaft extension 13 and its threaded portion, bracket 42, FIG. 1, is provided. Bracket 42 is actually a shroud shaped like a rimmed hat or a truncated hollow cone, to protect threaded portion 48, FIG. 12, from dirt. Shroud 42, shown in FIGS. 21 and 22, would be mounted onto the inside surface of lower portion 2 with a circular gasket with the width of bracket 42's circular flange, t.

Figure 29:
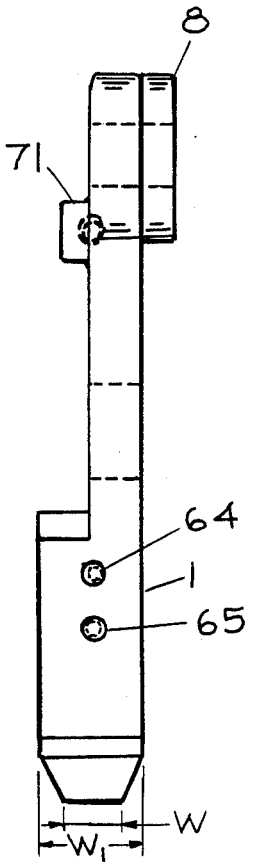
FIG. 29 is a side view thereof.

In FIG. 5, rods 38 and 39 with hammer heads 38' and 39' are provided to help share the horizontal forces occurring at the overlapping area 3, when heavy loads are suspended. Such hammerhead rods also could be provided for device 100, FIG. 1, about pivot pin 10, as shown. Protrusions 69 and 71 are provided, as shown in FIGS. 24 and 29, for mounting rods 70 and 72. The rods are screwed into threaded holes. Their hammerheads butt against each other when coupling device 100 has its lower portions 1 and 2 engaged and in contact. Detail drawings of rods 70 and 72 are not provided as they would be similar to FIGS. 17 and 19 except for details like flange 53, FIG. 19, and enlarged threaded end 52, FIG. 17. Instead of being threaded like rod 38, FIG. 19, rods 70 and 72 could be welded to protrusions 69 and 71, as an alternate method of attachment to upper portions 1' and 2', FIG. 1.

DESCRIPTION OF ANOTHER PREFERRED EMBODIMENT

Figure 31:
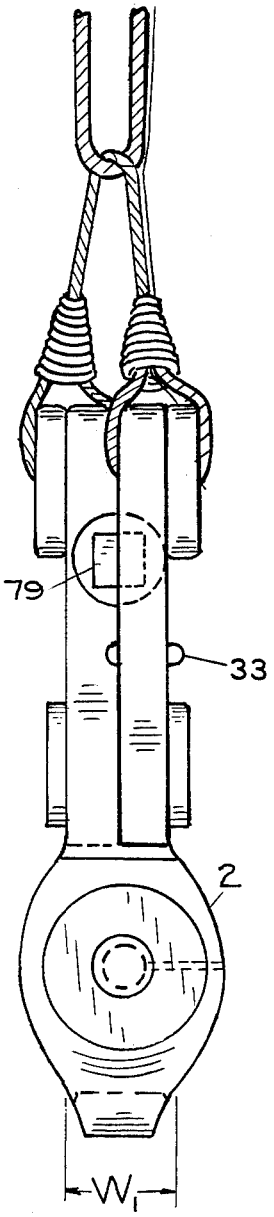
FIG. 31 is a side view thereof.
Figure 30:
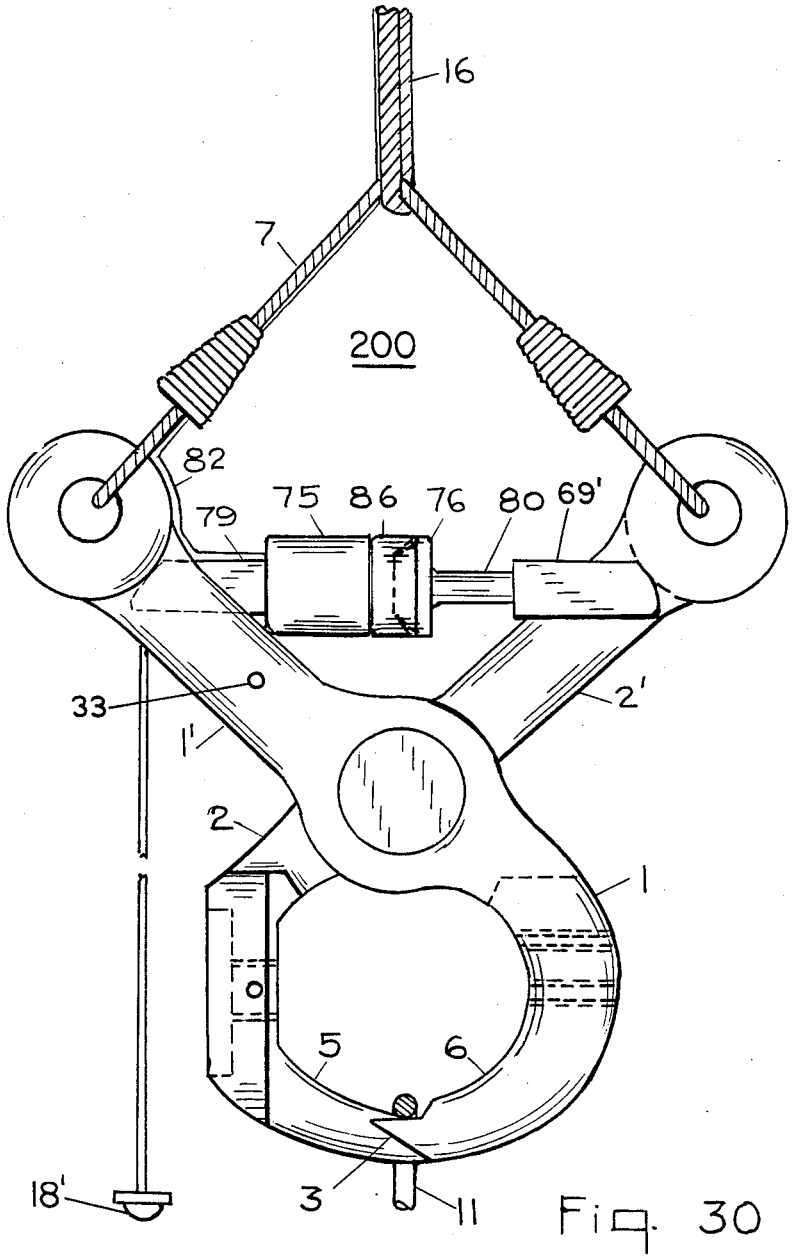
FIG. 30 is a front view of a coupling device in which positive retension of the load cable is acquired through an electromagnetic component located between the upper two portions of the device.
Figure 32:
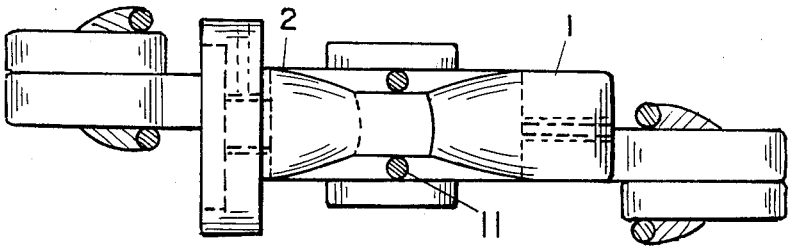
FIG. 32 is a bottom view thereof.
Figure 33:
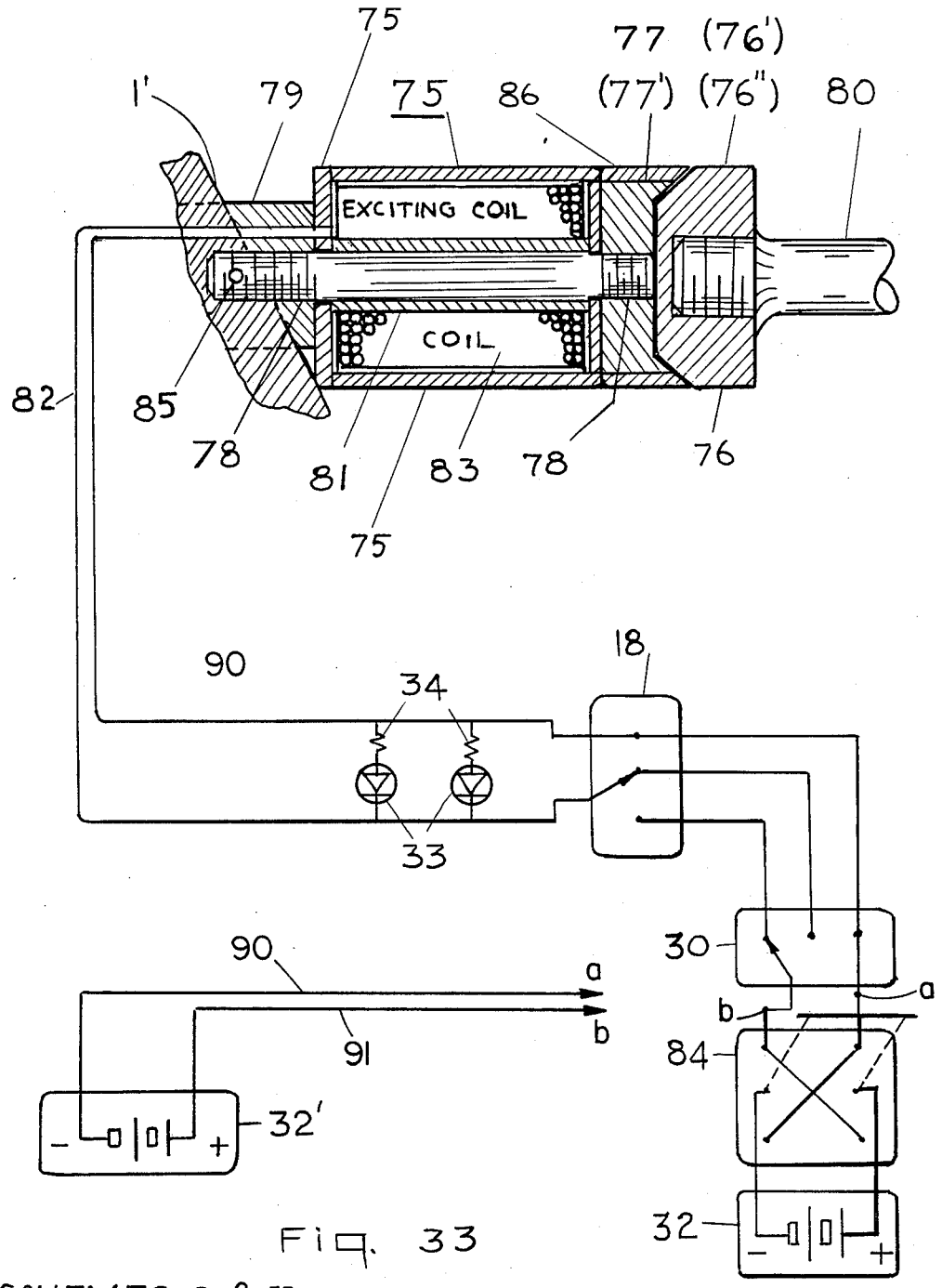
FIG. 33 is an electrical schematic of the circuitry for the electromagnetic component shown in FIG. 30. Approximately the same circuitry is used for three positive-load-retension schemes. The dashed lines separate two schemes from a third.

In the previous design solenoid 12 was used to achieve positive load-cable retension and prevent uncoupling of device 100 under any circumstances. In this alternate technique, an electromagnet 75, FIG. 30, between the device's upper two portions is used instead, making the design more streamlined, and possibly less complicated. FIGS. 30 to 32 show the new design in which an electromagnet is used for providing secure retention of the load cable under all environmental conditions. The same basic structure of FIG. 1 is used. In FIG. 1, the solenoid with its hooked shaft extension was used to provide secure load cable retention. The hammerheads, FIG. 1, were used to assume the major portion of the compressive stresses caused by cable 7 under suspension. Now in FIG. 30, hammerheads 86 and 76 perform the same function. In addition, solenoid 75, an integral part of extension 79, also is capable of providing secure retention of the load cable by means of magnetic attraction when energized. Comparing FIG. 1 with FIG. 30, parts 71 and 69 are equivalent to parts 79 and 69', FIG. 30. Rod 80 is equivalent to rod 70, core 78, FIG. 33, is equivalent to rod 72. LEDs 33 are shown on FIG. 30, the front view, and on the side view, FIG. 31, to indicate that one LED is mounted on each side of portion 1'. The wiring diagram for these LEDs are shown in FIG. 33. FIG. 32 shows a bottom view of device 200. Width $W_1$, shown in FIG. 31, is equal to the sum of the thicknesses of portions 1' and 2'.

FIG. 33 is an electrical schematic of the circuitry for the electromagnetic component, showing two SPDT switches and two LEDs for the simpler schematic. One double-throw polarity reversing switch 84 (DPDT) is shown, should reversing the polarity of the electromagnet be desired.

In a previous design, a solenoid 12 was used and located at the lower left portion of device 100. In FIG. 1, the solenoid, when deenergized, achieves positive retension of load cable 11, and allows the coupling device to detach load cable 11, when solenoid 12 is energized.

In an alternate design, the positive retention feature is achieved by an electromagnet (EM), located between the two upper portions of device 100, at the location of the rods with hammerheads. The new design is shown in device 200, FIGS. 30 and 33, with added EM 75. The EM component 75 is located between members 76 and 79.

To describe the operation of the positive retention system between upper portions 1' and 2', voltage is applied to EM 75, via wires 82 and voltage source 32', FIG. 33, by closing switch 18, scheme 1 of FIG. 33. The lines of force produced by the exciting coil 83, FIG. 33, also produces magnetic poles in stationary core 78, thus north and south poles are created. By making member 77 nonmagnetically attractable and nonconductive, the magnetic lines of force are attracted to member 76, which is ferrous and of soft steel. In addition, the pole produced at the end of core 78 attracts ferrous member 76; thus, the two hammerheads 76 and 77 are strongly urged toward each other to produce positive retention of load cable 11, the positive retention occurring only while voltage is being applied to coil 83. Ends of core 78 are shown screwed into members 77 and 79. Pin 85 holds core 78 in place. When desiring to unload cargo, coil 83, FIG. 33, is deenegerized by opening either switch 18 or 30. Because hammerhead 76 is of low permeability iron, the metal retains very little magnetism and the two members 76 and 77 are free to separate from each other, when the suspended cargo has been deposited on a platform. This describes scheme I's operation and construction. Scheme II does not require EM 75 to be energized for positive retention of the load cable 11. At this point it should be noted that thick rod 80 is screwed into member 76, or rather that 76 is screwed into 80.

Scheme II is an alternate design for positive retention of cable 11. Voltage is supplied by source 32' via wires 90 and 91 to indicated points a and b at input to switch 30. Switch 84 and supply 32 would be disconnected from switch 30. In this technique member 76 is a permanent magnet with its N and S poles forward and rear, and is renumbered 76'. Physically 76' is approximately the same size and shape as 76. Then, hammer-head 77 is replaced by a soft-steel, magnetically-attractable member 77', uncapable of retaining residual magnetism, also approximately the same size and shape as 77. Member 76' could be an alnico permanent magnet. Thus normally the two members 76' and 77' would be attracted to each other to help keep device 200 coupled during suspended load conditions. When device 200 has placed the suspended load on a platform for detachment of load cable 11, then either switch 18 or 30 is toggled to close the electrical circuit. This causes voltage to be applied to EM 75 of the desired polarity to produce lines of force of slightly greater intensity than those of magnet 76'. Thus without members 76' and 77' attracting each other, device 2' is free to decouple. In this scheme energy is applied to the electromagnet only when uncoupling device 200 is required, while in scheme I, energy is required only during positive retension of load cable 11. Scheme II would be slightly more complicated because of the presence of the magnetic member 76'.

Scheme III is a second alternate design for positive retention of cable 11. In this technique the electromagnet (EM) is continuously energized, either to reenforce the magnetic lines of force of weaker magnet 76" or to counteract and nullify the tractive effect of magnet 76". It also should be mentioned that original hammerhead 77 replaces member 77', and member 76' is replaced by weaker magnet 76". Switch 84, FIG. 33, enables one to reverse the polarity of EM 75 to achieve the desired effect. The voltage source is now 32, and source 32' is disconnected. When it is desired to achieve positive retension of load cable 11, EM 75's polarity is such as to reenforce the magnetic field of magnet 76". When decoupling device 200 is required, switch 84 is reversed to enable EM 75 to create a magnetic field that will repel the field of magnet 76", to cause members 76" and 77 to want and be urged to separate, and allow load cable 11 to detach itself from device 200 when the suspended load has made contact with a rigid surface below. Only when device 200 is not in use is when the EM's circuit is opened, via either switch 18 or switch 30. Illuminated LEDs would indicate that the switch is closed, while unilluminated LEDs would indicate that the switch is open. When EM 75 is deenergized, there would be some magnetic attraction between members 76" and 77, to keep them in contact with each other, which may be desirable, because of weaker magnet 76". In this technique less energy would be needed and applied to the EM at any one time or instance to produce the same attraction between members 76" and 77, than in scheme I, but the energy from a voltage supply would need to be supplied continuously. Members 75 and 86 are of soft steel.

In addition to achieving positive retention of the load cable, all of the three schemes perform the function of relieving some of the structural stress of the contacting ends 3 of lower portions 5 and 6, FIG. 30. The advantage of schemes I, II, III over the previous techniques is that there is no possibility of the load cable becoming hooked onto rods 13 and 14, FIG. 1, or onto rods 38 and 39, FIG. 5. A further advantage is that hammerheads 70 and 72, FIG. 1, or 38 and 39, FIG. 5, have been incorporated into electromagnet 75, thus reducing the number of parts that are required and shown in FIG. 1. Like hammerheads 76 and 86, FIG. 30, hammerheads 38' and 39'. FIGS. 19 and 17, also could be provided with a recession and a protrusion at their extremities, the protrusion fitting snugly into the hammerhead with the recession when the two are abutted, thereby maintaining the alignment of bars 38 and 39 under high compressive stress conditions imposed by a heavy suspended load.

I claim:

1. A hoist cable coupling device with cable-scooping capability for quickly loading and unloading cargo remotely, comprising a forceps-like part A, having two elongated members with sharply-curved lower portions and straight upper portions, pivoted near said members' mid-section with a pivot pin, and having a solenoid with a shaft extension, for use with hoist and load cables, both said cables being adapted for attachment to said part A, said lower portions having complementary-shaped ends which overlap when in contact with each other; one of said lower portions having a rotary solenoid fastened firmly to a shallow cylindrical cavity on its side, having said shaft extension extending toward the inside of said lower portions and the end of said shaft extension having a right-angle bend, to engage a rod with a right-angle bend, extending toward the inside from the other of said lower portions, the two right angle bends engaging with each other to keep said ends of said lower portions in overlapping contact as a safety precautionary measure, when said solenoid is de-energized and said cargo is in suspension; and when desiring to unload said cargo, said solenoid is energized, causing said rod and said shaft extension to disengage and to allow said lower portions to separate in order to permit said load cable to detach itself from one of said lower portions.

2. A hoist cable coupling device in accordance with claim 1, wherein each of said lower portions has an inside surface, and wherein said complementary-shaped ends are dovetailed slightly near said inside surface so as not to interfere with the detachment of said load cable from said device, to enable said ends of said lower portions, making contact under load conditions, to be capable of withstanding higher structural stresses.

3. A hoist cable coupling device in accordance with claim 1, and wherein said upper portions have inside surfaces and wherein two rods, each with a hammerhead at one end, are attached to said inside surfaces, such that one of said rods is attached to one of said inside surfaces with said hammerhead extending inward, and the other of said rods being attached to the other of said inside surfaces with said hammerhead extending inward, said hammerheads butting against each other when said ends of said lower portions are in contact with each other, in order to help share the structural stresses when said device supports said cargo; said hammerheads separating from each other when said ends of said lower portions separate from each other.

4. A device in accordance with claim 1, and wherein said device includes two light emitting diodes, one mounted on each side of said device, with their circuitry in the electrical wiring loop of said solenoid so that when said solenoid is energized, said diodes illuminate, indicating to the operator of said hoist cables that said solenoid has been energized, thereby assuring said operator that power has been applied to said solenoid to permit disengagement of said load cable, suspending a load; whereby when said solenoid is de-energized, said device being in positive load retenion.

5. A hoist cable coupling device for quickly releasing suspended cargo remotely and automatically, comprising a forceps-like part A, having two elongated members, pivoted near their mid-section with a pivot pin, having two fastened rods, each with a hammerhead at one end, for use with hoist and load cables, both said cables being adapted for attachment to said part A, said members having straight upper portions and sharply-curved, toward-each-other lower portions, wherein said upper portions have inside surfaces, and wherein one of said rods is attached to one of said inside surfaces with said hammerhead extending inward and the other of said rods being attached to the other of said inside surfaces with said hammerhead also extending inward; said lower portions having ends that are forced into contact with each other because of the tension on said hoist cable when said device supports said cargo; said ends overlapping and mating with each other and each said hammerhead butting against the other, under said suspended cargo conditions; whereby said lower portions will separate when said cargo comes in contact with a rigid surface and the tension in said hoist cable is significantly reduced, freeing said load cable from said lower portions by the force of gravity; said ends of said lower portions coming into contact again when tension is restored in said hoist cable, when said device is lifted.

6. A hoist cable coupling device in accordance with claim 5, wherein one of said lower portions has an outside surface, and wherein means being available for attachment of a cord to said outside surface, said means being an eyelet rigidly fastened to said surface to enable a user of said device to pull on said cord momentarily when lifting said device by said hoist cable, in order to avoid reloading said load cable with said mating ends, and to allow said cargo to remain on said rigid surface.

7. A hoist cable coupling device in accordance with claim 5, and wherein for added safety in maintaining said ends in contact under all environmental conditions, one of said rods having a soft steel hammerhead and an integrated electromagnet with an exciting coil, the other of said rods having a hammerhead of magnetic material, thereby to achieve positive retention of said suspended cargo by magnetic attraction of one of said hammerhead for the other said hammerhead, said electromagnet having been de-energized by removing the voltage from said exciting coil, whereby when said electromagnet is energized, the lines of magnetic force produced by said electromagnet forming a magnetic field which would oppose the magnetic field produced by said magnetic material, the polarities of the two said fields being of the same strength and of the same polarity, thus allowing said coupling device to uncouple and free said load cable from said device when said cargo makes contact with a rigid surface below; said hammerheads when abutting also sharing the structural stresses imposed on said ends of said lower portions when supporting said cargo.

8. A hoist cable coupling device in accordance with claim 5, and wherein for added safety in maintaining said ends firmly in contact under all environmental conditions, one of said rods having a soft steel hammerhead and an integrated electromagnet with an exciting coil, the other of said rods having a hammerhead of low strength magnetic material, and wherein a double-throw voltage polarity reversing switch, connected to a voltage supply, is the source of energy for said exciting coil, said switch being capable of reversing said voltage polarity to said exciting coil whereby with said switch flipped in one direction, said coil is so excited as to produce magnetic lines which achieve strong magnetic attraction of said hammerheads by reenforcing the magnetic lines produced by said low strength magnetic material, thus to achieve and maintain said contact of said ends of said lower portions and with said switch flipped in the reverse direction, said coil is excited to produce magnetic lines which oppose and nullify said magnetic lines produced by said magnetic material, thus allowing said coupling device to uncouple said coupling device and free said load cable attached to said cargo; said hammerheads when abutting also sharing the structural stresses imposed on said ends of said lower portions when supporting said cargo; whereby also the combination of said reversing switch and said low strength magnetic material requiring less power application to said exciting coil of said electromagnet to achieve said strong magnetic attraction.

9. A hoist cable coupling device with cable-scooping capability for quickly loading and unloading suspended cargo remotely, comprising a tongs-like part A, having two elongated members with sharply curved lower portions and straight upper portions, pivoted near said members' mid-section with a pivot pin, and said lower portions having two fastened rods, each of said rods having a hammerhead at one end; for use with hoist and load cables, both said cables being adapted for attachment to said part A, wherein said lower portions, curved toward eachother, have inside surfaces, and wherein one of said rods is attached to one of said inside surfaces with said hammerhead extending inward and the other of said rods being attached to the other of said inside surfaces with said hammerhead also extending inward; said lower portions having ends that are forced into contact with each other because of the tension on said hoist cable when said device supports said cargo; said ends overlapping and mating with each other and each said hammerhead butting against the other, under said suspended cargo conditions; whereby said lower portions will separate when said cargo comes in contact with a rigid surface and the tension in said hoist cable is significantly reduced, freeing said load cable from said lower portions by the force of gravity; said ends of said lower portions coming into contact again when tension is restored in said hoist cable, when said device is lifted; each said hammerhead when abutting also sharing the structural stresses imposed on said ends of said lower portions.

10. A hoist-cable coupling device for quickly releasing suspended cargo remotely, having back-up load retention means, comprising a tongs-like part A, having two elongated members, pivoted near their mid-section by a pivot pin, for use with a hoist and a load cable, each cable being adapted for attachment to said part A, said members having upper and lower portions, said lower portions having complementary-shaped ends which engage when supporting said load cable, because of the tension on said hoist cable when said device supports said cargo; said upper portions having inside surfaces with a rod fastened horizontally to each of said inside surfaces, and each said rod having a hammerhead at one end, and each said hammerhead extending inward; one said rod also having an integrated electromagnet with an exciting coil and a magnetizable hammerhead, and the other said rod having a soft-steel receiving hammerhead, one said hammerhead capable of butting against the other said hammerhead when said device supports said load; wherein for added safety in maintaining said ends firmly in contact under all environmental conditions, said electromagnet is energized by applying voltage to said coil to produce lines of force that pass through said soft-steel hammerhead, for obtaining the required tractive force for adhering said magnetizable hammerhead against said receiving hammerhead, for providing positive and secure retention of said load cable, until said electromagnet is de-energized; said back-up load retention means being said tension on said hoist cable when said device supports said cargo, because of said device's weight distribution, should said electromagnet become de-energized accidentally; each said hammerhead when abutting also sharing the structural stresses imposed on said ends of said lower portions.

11. A device in accordance with claim 10 and wherein said receiving hammerhead having a recess at its exterior end and the other said hammerhead having a protrusion at its exterior end, said protrusion fitting snugly into said recess when said hammerheads are abutted, in order to ensure alignment of said hammerheads under suspended load conditions, thus providing more symmetrical and uniform stress distribution within each said hammerhead, when abutting one said hammerhead against another.

* * * * *

UNITED STATES PATENT AND TRADEMARK OFFICE

CERTIFICATE OF CORRECTION

PATENT NO. : 4,717,189
DATED : Jan. 5, 1988
INVENTOR(S) : Edwin Z. Gabriel

It is certified that error appears in the above—identified patent and that said Letters Patent is hereby corrected as shown below:

In claim 10, Col. 12, line 49, delete "and" and substitute --; said back-up load retention means being --.

Col 12, line 52, delete "magnetizable hammerhead" and substitute, -- non-magnetizable hammerhead but with a magnetizable core rod --.

Col. 12, line 64, delete the second "said" and in line 65 delete "back-up" and substitute -- the primary --.

Signed and Sealed this

Thirty-first Day of October, 1989

*Attest:*

*Attesting Officer*

DONALD J. QUIGG

*Commissioner of Patents and Trademarks*